US005763229A

United States Patent [19]

Kobayashi et al.

[11] Patent Number: 5,763,229

[45] Date of Patent: Jun. 9, 1998

[54] TONER FOR DEVELOPING ELECTROSTATIC LATENT IMAGE

[75] Inventors: Makoto Kobayashi, Settsu; Masahiro Anno, Sakai; Minoru Nakamura, Itami, all of Japan

[73] Assignee: Minolta Co., Ltd., Osaka, Japan

[21] Appl. No.: 730,726

[22] Filed: Oct. 11, 1996

[30] Foreign Application Priority Data

Oct. 13, 1995 [JP] Japan ..... 7-265273

[51] Int. Cl.[6] ..... G03G 9/107

[52] U.S. Cl. ..... 430/106.6; 430/110

[58] Field of Search ..... 430/106, 110, 430/111

[56] References Cited

U.S. PATENT DOCUMENTS

| | | | |
|---|---|---|---|
| 4,828,955 | 5/1989 | Kasai et al. | 430/111 |
| 4,968,577 | 11/1990 | Kohri et al. | 430/111 |
| 4,985,327 | 1/1991 | Sakashita et al. | 430/111 |
| 4,996,126 | 2/1991 | Anno et al. | 430/106.6 |
| 5,080,992 | 1/1992 | Mori et al. | 430/109 |
| 5,118,587 | 6/1992 | Takaragi et al. | 430/109 |
| 5,240,803 | 8/1993 | Ota | 430/106 |
| 5,429,902 | 7/1995 | Saito et al. | 430/110 |

*Primary Examiner*—John Goodrow

[57] ABSTRACT

A toner for electrophotography including toner particles containing at least a binder resin and a colorant, and a fluidizing agent added externally to the toner particles for mixture therewith, wherein the aerated apparent density A ($g/cm^3$) of the toner, the volume mean particle size D (μm) of the toner particles, and the aspect ratio B of the toner particles satisfy the following relations:

$29 \leqq 100A - D \leqq 35$ $5 \leqq D \leqq 8$ $1.25 \leqq B \leqq 1.40$

20 Claims, 1 Drawing Sheet a:DIRECTION OF ROTATION OF MAGNETIC ROLL b:DIRECTION OF ROTATION OF DEVELOPER

TONER FOR DEVELOPING ELECTROSTATIC LATENT IMAGE

BACKGROUND OF THE INVENTION

1. Field of the Invention

The present invention relates to a novel toner for developing electrostatic latent images which is used for imaging method in electrophotography and the like. Particularly, the invention relates to a toner having good fluidity and cleaning characteristics.

2. Description of the Related Art

Hitherto, it has been common that a toner for developing electrostatic latent images which is used for imaging method in electrophotography is produced by a melting-kneading-pulverizing process or a wet granulating process, such as a suspension polymerization process.

Fundamental powder characteristics required of a toner include fluidity and cleanability. In the aspect of fluidity, it is necessary that when toner is supplied from a toner bottle into a developing device, the toner should exhibit good fluidity such that it can be smoothly fed with no blocking occurrence in the imaging device such as copying machine or electroprinter. In the aspect of cleanability, it is necessary that for the purpose of blade cleaning for removal of any transfer toner residue on photosensitive body, toner particles should have some degree of surface irregularity for preventing possible toner particle slip off from the clearance between the blade and the photosensitive body.

A toner produced by a pulverization process is generally irregular in particle configuration. This is advantageous in respect of cleanability, while on the other hand such irregularity means lower fluidity. In order to provide sufficient fluidity, therefore, it is necessary to increase the amount of addition of a fluidizing agent. However, an increase in the amount of fluidizing agent may be a cause of imperfect cleaning and/or filming on the photosensitive body. A toner produced by a wet granulating process is spherical in configuration and is capable of maintaining high fluidity without addition of any fluidizing agent. However, this type of toner has a drawback that use of the toner is apt to cause the trouble of imperfect cleaning.

Recently, the use of imaging device, such as copying machines, has become very popular and accordingly such units have become more versatile in areas of application in which they are used. In such situation, requirements for image quality have become much demanding. In order to ensure provision of high precision images, the use of smaller particle-size toners, or more particularly toners having a particle size of not more than 10 μm, has been proposed. As the particle size of toner is reduced, it becomes necessary that various toner compositions be more uniformly dispersed. In fact, however, it becomes increasingly difficult to effect dispersion in proportion as toner particle size is reduced, and this results in a wider distribution of charge amount of developer, in an increase in the proportion of unsatisfactory charged toner, and in poor cleanability of toner.

SUMMARY OF THE INVENTION

It is an object of the present invention to provide a novel and useful toner for developing electrostatic latent images which is clear of the above mentioned problems.

It is another object of the invention to provide a toner which, even in a small particle size, has good fluidity and is unlikely to cause the trouble of imperfect cleaning.

It is still another object of the invention to provide a toner which can produce high precision images.

It is a further object of the invention to provide a toner having good charge bearing characteristics.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
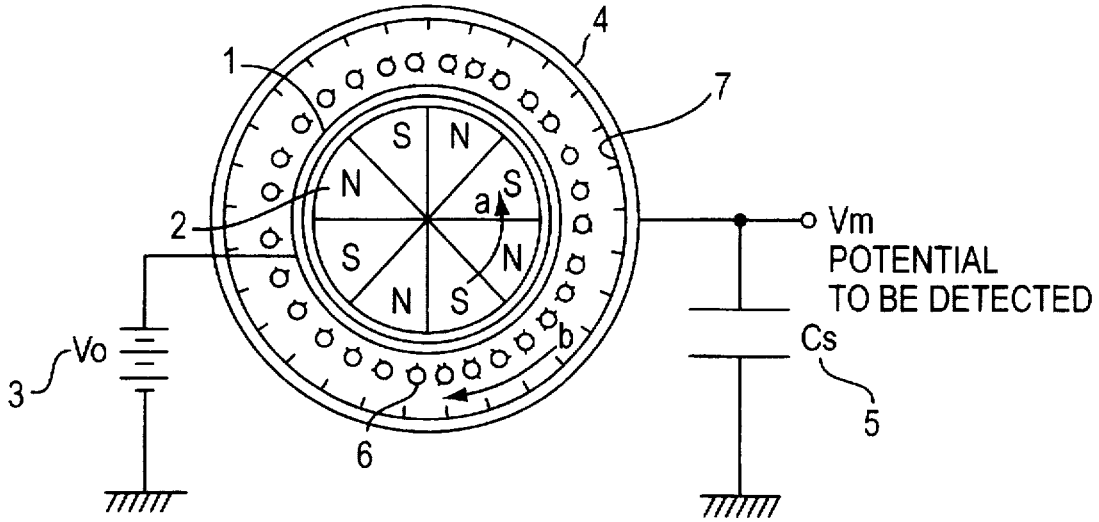
FIG. 1 is a schematic view showing general construction of a toner charge measuring device.

The toner for developing electrostatic latent images in accordance with the present invention is the toner comprising at least resin material, charge control agent, and colorant and having a volume mean particle size of 5–8 μm, wherein aerated apparent density A (g/cm$^3$) and volume mean particle size D (μm) satisfy the relation:

$$29 \leqq 100A - D \leqq 35 \quad (5 \leqq D \leqq 8)$$

and wherein aspect ratio is within the range of from 1.25 to 1.40.

The present inventors directed their attention to the facts that the fluidity of the toner has a strong relation with the aerated apparent density of the toner, and that the cleanability of the toner upon which the configuration of toner particles has some bearing has a strong relation with the aspect ratio (long/short ratio) of particles of the toner, and made an extensive study on quantitative relationships between toner characteristics and these parameters.

As a result, it was found that when the aerated apparent density satisfied the relation $29 \leqq 100A - D$ (where, D represents volume mean particle size (μm); $5 \leqq D \leqq 8$), fluidity adequate for enabling toner replenishment could be assured and that when the relation $100A - D \leqq 35$ is satisfied, the occurance of imperfect cleaning could be preveneted. Further, it was clarified that by setting the aspect ratio in the range of 1.25 to 1.40, it was possible to obtain toner particles capable of exhibiting good fluidity and good cleanability even when the amount of addition of a fluidizing agent was relatively small.

Precisely, when A and D of the toner satisfy the relation:

$$29 \leqq 100A - D \leqq 35$$

and when the aspect ratio is within the range of from 1.25 to 1.40, the toner has good fluidity and good cleanability. More preferably, $$31 \leqq 100A - D \leqq 33$$

and a more preferable aspect ratio is in the range of 1.30–1.38.

If the aspect ratio is less than 1.25, toner particles are highly spherical and are liable to cause the trouble of imperfect cleaning. If the ratio is more than 1.40, toner particles have high irregularity and are unlikely to exhibit good fluidity.

It is noted that "aspect ratio" herein indicates the ratio of maximum longitudinal length to transverse length passing the center of gravity in orthogonal relation to the longitudinal length in toner particle images. The term "aerated apparent density" herein relates to a value with respect to toner particles after addition of a fluidizing agent.

Aspect ratio, as a shape factor, is controllable in the process of manufacture. For example, when it is desired to change surface configuration of toner particles obtained through the process of kneading and pulverizing under mechanical impact force applied in a hybridization system or the like, toner particles may be subjected to higher stress by increasing the rotational speed of the rotor or increasing the time for processing, or the like, whereby the aspect ratio is rendered lower. When a lower stress is applied, a higher aspect ratio can be obtained.

Also, by using a method wherein polymerizing particles, after having been thermally aggregated, are subjected to disintegration by a mechanical grinder, it is possible to control particle configuration according to the conditions of aggregation. For example, when the degree of aggregation is lower, particles can be more easily disintegrated and this results in a lower aspect ratio. When the degree of aggregation is higher, the configuration of particles after disintegration is more irregular, which results in a higher aspect ratio.

In order to obtain aerated apparent density and aspect ratio values within above noted ranges, it is desirable to control the degree of particle aggregation by selecting conditions for particle aggregation and conditions for disintegration of aggregate so that the aerated apparent density with respect to the aggregates is within a certain range, preferably, within a range expressed by the relation:

$$0.10 \leqq A_1 \times A_2 \leqq 0.15$$

where, $A_1$ represents aerated apparent density of toner; and $A_2$ represents aerated apparent density of aggregates of polymer particles or toner material particles. More preferably, selection is made so that the aerated apparent density is within a range expressed by the relation:

$$0.11 \leqq A_1 \times A_2 \leqq 0.14$$

A method for production of toner particles will now be described.

First, granulation is carried out according to wet granulation techniques. Specifically, such granulation techniques include a suspension process wherein a colorant and other desired additives are dispersed in a solution in which a binder resin is dissolved, the dispersion being suspended in the form of spherical-particle dispersion in a solvent incompatible with aforesaid solution, the solvent being removed from the dispersion suspension, whereby smaller-size spherical toner particles are obtained; a suspension polymerization process wherein a monomer solution with a colorant and other desired additives dispersed therein is suspended in the form of spherical-particle dispersion in a solvent incompatible with the monomer solution, the monomer being polymerized in a suspended condition, whereby smaller-size spherical toner particles are obtained; an emulsion polymerization process wherein a monomer is polymerized in a micelle; and a seed polymerization process. In addition to the foregoing, it is also possible to employ a spray drying method, and a method for granulation of non-spherical toner particles into spherical particles through heat treatment or application of mechanical impact force.

The toner particles obtained by wet granulation in this way (hereinafter referred to as "parent toner material") should have a number-mean particle size (hereinafter referred to as "mean particle size") of 2–9 μm, preferably 3–8 μm. After toner particles (parent toner material) are thus formed through the process of granulation in a liquid medium, the parent toner material is preferably added with water-insoluble organic and/or inorganic particulate. Through addition of such particulate it is possible to stably obtain aggregates of desirable size and also to stably carry out fusion operation. Moreover, such addition results in remarkable improvement in disintegratability of aggregates in the subsequent disintegrating stage.

Examples of such organic and inorganic particulate include charge control agent, fluidizing agent, magnetic particles, anti-offset agent and cleaning assistant which may be used alone or in combination of two or more. For addition of these additives to the parent toner material, not all kinds of additives need to be present as such particulate on the surface of parent toner material, but some of them, in mixture with the binder resin and colorant, may be incorporated into the parent toner material. It is also possible to arrange that while such additives are internally present in the parent toner material, same kind of additives are present in the form of particulate as deposited on the surface of the parent toner material.

The particle size of such organic and/or inorganic particulate to be used as aforesaid should be not larger than 1/5, more preferably on the order of from 1/1000 to 1/10, of mean particle size of granulated parent toner material. If the particle size of such organic or inorganic particulate is larger than 1/5 of the mean particle size of the parent toner material, even after the parent toner material has gone through the stage for aggregation thereof, it may be unlikely that such organic or inorganic particulate is allowed to deposit on the surface of toner particles with sufficient adhesion effect. If the particle size of such particulate is too minute, it may not be possible to take advantage of various kinds of particulate added.

The quantity of addition of such organic and/or inorganic particulate(s) is 0.01 to 20 parts by weight, preferably 0.01 to 10 parts by weight, more preferably 0.1 to 5 parts by weight, relative to 100 parts by weight of the parent toner material, depending upon the function, kind, etc. of the organic or inorganic particulate used. If the addition of such organic or inorganic particulate(s) is less than 0.01 part by weight, the amount of organic or inorganic particulate present on the surface of the parent toner material as deposited thereon is insufficient so that such particulate may not effectively function. If the addition of such organic or inorganic particulate(s) is more than 20 part by weight, even after the step of agglomerating the parent toner material is carried out, some portion of such organic or inorganic particulate may not deposit with good adhesion effect on the surface of the parent toner material and may become liberated from toner particle surface when the toner is in use.

Addition of above described particulate(s) (including the case of charge control agent) to parent toner material may also be made in any of the following ways. That is, (a) in an aqueous medium the particulate is added to a parent material composed principally of binder particles and a colorant and all are mixed together, the mixture being then formed into aggregates; (b) in an aqueous medium the parent toner material is formed into aggregates, and the aggregates, held in dry condition, are added with the particulate(s); (c) the parent toner material is formed into aggregates, which are dried and then added with the particulate(s); and (d) granulated parent toner material in dry condition is added with the particulate(s). Most preferred of these is method (c).

For aggregation of parent toner material, known agglomerating agents may be used including, for example, an inorganic acid, such as hydrochloric acid, an organic acid, such as oxalic acid, and a water-soluble metallic salt of such acid with alkaline earth metal, aluminum, and the like. It is noted, however, that care must be exercised in using such agglomerating agent because such an agent may affect the performance of the toner.

Several other methods may be considered for agglomerating the parent toner material. For example, (1) prior to the step of drying, a liquid medium in which parent toner material and, where desired, aforesaid organic or inorganic particulate(s) are dispersed is heat treated (for example, at a temperature higher than the glass transition temperature (Tg) of the resin contained in the parent toner material but lower than the boiling point of the liquid medium); or (2) prior to the step of drying, a solution containing a nonaqueous solvent which exhibits solubility and/or a swelling ability in relation to aforesaid resin is brought in contact with a parent toner material having aforesaid organic or inorganic particulate deposited on its surface as desired.

Another method is: (3) a dried parent toner material, with aforesaid organic or inorganic particulate(s) deposited on the surface thereof as desired, is heat treated (at a temperature higher than the glass transition temperature (Tg) of the resin contained in the parent toner material but lower than the softing temperature (Tm) of the resin plus 60° C.). A further method is: (4) a dried parent toner material having aforesaid organic or inorganic particulate deposited on its surface as desired is brought in contact with a solution containing a nonaqueous solvent which exhibits solubility and/or a swelling ability in relation to the resin component contained in the parent toner material, and is then dried once again.

Another method is: (5) one or both of the temperature and pressure at the step of drying is set somewhat higher than general drying conditions. Or, (6) at the drying step, a solution containing a nonaqueous solvent which exhibits solubility and/or a swelling ability in relation to the resin component of the parent toner material is brought in contact with the parent toner material. Of course it is possible to use two or more of the foregoing methods in combination.

In the above enumerated methods (1) to (6), after the drying step, aggregates formed are kept under high humidity conditions so that more reasonable aggregation effect can be obtained.

Through such process of aggregation as above described individual particles of the parent toner material become melted, dissolved or swollen on their surfaces so that individual parent toner particles join with one another to form aggregates. By controlling such state of aggregation it is possible to modify the irregularity of toner as a final form of developer. Assuming that the subsequent grinding stage is carried out under same conditions, the greater is the degree of melting, dissolving, or swelling, the larger is the irregularity of toner particles finally produced. In order to initially produce spherical toner particles, however, it is desirable to set conditions for aggregation rather low by using lower temperatures for processing and/or by setting processing time shorter. Specific temperature and time conditions may be suitably selected according to the mode of processing.

Additionally, pressure control is effective for control of particle shape too. For example, by carrying out processing under reduced pressure it is possible to increase the ratio of spherical particles.

The inter-particle binding force of particles of parent toner material in aggregated state is influenced to a certain degree by particle size of such particles. There is a tendency that the smaller is the particle size, the greater is the binding power of the particles. Therefore, even if particles of parent toner material formed in aforesaid wet granulation stage which are within a main particle size range of the parent toner material (e. g., of the order of from 2 to 8 μm) are of comparatively low binding force in their inter-particle bond relation and are aggregated in such a way that they may be readily severed or crushed by a minor external force applied at their bond interfaces, extra fine particles having a particle size of, for example, not larger than 1 μm have a binding force sufficient to enable them to go into strong bond with such larger particle size as are within, for example, above mentioned particle size range, so that the extra fine particles are little likely to be separated from the larger particles even upon a subsequent application of such external force as above mentioned.

For purposes of isolating or fractionating parent toner material or aggregates from the solution, a "non-solvent" may be used as a precipitant. The term "non-solvent" used herein means a solvent which does not dissolve or disperse the resin component of parent toner material. Examples of such non-solvent includes hydrocarbons, such as hexane, heptane, octane, and petroleum ether, and lower alcohols, such as methanol and ethanol.

Drying step for parent toner material may be carried out after or simultaneously with the agglomerating step, or prior to the agglomerating step as earlier stated, and by employing any conventional drying apparatus, such as hot air drying unit or spray dryer, which is commonly used. In the case where particles of parent toner material are to be aggregated at the drying stage, for example, machines, such as medium fluidized drying machine (e. g., "MSD", made by Nara Kikai Seisakusho Co.) and wet type surface modification unit (e.g., "Dispercoat", made by Nisshin Engineering Co.), may be conveniently employed.

Prior to the disintegration step, it is desirable that aggregates of parent toner material be mixed with a charge control agent. Mixing may be carried out by using a Henschel mixer, a ball mill, or any other known means.

In order to enhance dispersion of the charge control agent into toner aggregates, it is desirable that a metallic oxide, such as silica, titanium oxide, and aluminum oxide, be mixed, as auxiliary dispersing agent, along with the charge control agent, into the toner aggregates. Preferably, the metallic oxides has been rendered hydrophobic by a hydrophobicity imparting agent. The amount of addition of the auxiliary dispersing agent is 0.01 to 5 parts by weight, preferably 0.1 to 3 parts by weight, relative to 100 parts by weight of toner aggregates.

Toner aggregates obtained in this way are subjected to disintegration by a mechanical grinder in the presence of a charge control agent and in dried condition.

A preferred mechanical grinder for use in disintegrating such aggregates is such that the grinder includes a cylindrical hollow body (outer cylindrical body) having grooves formed on the inner periphery thereof and a freely rotatable cylindrical body (inner cylindrical body) spaced a specified clearance from that inner periphery and having grooves formed on the outer periphery thereof.

Examples of such a useful mechanical grinder includes "Criptoron" (made by Kawasaki Heavy Industries Inc.), "Turbo-Mill" (made by Turbo-Mill Kogyo Inc.), and "Fine Mill" (made by "Nihon Pneumatic Kogyo Inc.).

Aforesaid disintegrating operation concurrent with charge control agent addition, with respect to toner aggregates, may be carried out in a closed circuit and on a plural pass basis.

More specifically, toner particles resulting from disintegration by a mechanical grinder, with charge control agent affixed to particle surface concurrently with the disintegration, are classified in such a way that coarse particles having a larger particle size than mean particle size are returned to the mechanical grinder for circulation through the circuit.

Through this process it is possible to obtain a toner having higher fluidity and blade cleanability, because charge control agent that has failed to be affixed to or has been incompletely affixed to toner particle surface can be more firmly affixed to toner particle surface.

While the toner thus obtained comprises a binding resin and a colorant, with a fluidizing agent being externally loaded for mixture with particles of the toner, the toner may include other additive or additives admixed therewith as required.

Available for use as a binding resin for toner particles are various types of thermoplastic resins including, for example, styrene resin, acrylic resin, styrene-acryl copolymer, styrene-butadiene copolymer, polyester resin, epoxy resin, polyamide resin and derivatives thereof.

Available for use as a fluidizing agent which is to be externally admixed with toner particles are inorganic particulate materials, such as silica, alumina, and titania, which have a BET specific surface area of from 50 to 250 $m^2/g$, preferably of from 80 to 180 $m^2/g$. such particulate material is externally added for mixture with toner particles. From the view point of environmental stability, it is preferable that the fluidizing agent has been hydrophobically treated with a hydrophobicity imparting agent, such as silane coupling agent, titanate coupling agent, aluminum coupling agent, and silicone oil. In particular, it is preferable to use a fluidizing agent which has been hydrophobically treated by a methanol wettability method so as to provide a hydrophobicity of 50 or more. For the purpose of regulating the charge bearing property of the fluidizing agent, the fluidizing agent may be surface treated by using, in combination with the hydrophobicity imparting agent, a fluorine-containing silane coupling agent, a fluorine-containing silicone oil, an amino-silane coupling agent, an amino-silicone oil, or the like.

For the charge control agent, those generally known in the field of electrophotography may be used including, for example, negative charge control agents, such as metal salicylate complex, metal naphthenate complex, metal-containing complex type azo dye, organic boron complex, calix arene compound, bisphenol-S compound, bisphenol-A compound, and fluorine-containing quaternary ammonium salt compound, and positive charge control agents, such as nigrosine dye, imidazole compound, and quaternary ammonium salt compound. The charge control agent may be either internally mixed into toner particles or externally loaded and affixed to toner particle surface. However, external loading for fixation to toner particle surface is preferred because a smaller quantity of charge control agent is required for enhancement of the charge bearing performance of the toner.

For purposes of improving the charge bearing capability of the toner, an inorganic particulate material, such as silica, alumina, or titania, may be used through external loading of the same for fixation to toner particle surface. From the view point of environmental stability, it is preferable that such inorganic particulate has been hydrophobically treated with a hydrophobicity imparting agent, such as silane coupling agent, titanate coupling agent, aluminum coupling agent, or silicone oil. Where it is desired to improve the negative charge bearing performance, surface treatment may be carried out by using a fluorine-containing coupling agent, amino-silicone oil or the like, or where it is desired to improve the positive charge bearing performance, by using an amino-silane coupling agent, amino-silicone oil or the like, in combination with the hydrophobicity imparting agent.

In order to improve the heat resistance or the Like of toner particles, various types of fine resin particles, as granulated by wet polymerization methods, such as emulsion polymerization, soap-free emulsion polymerization, and non-aqueous dispersion polymerization, or vapor phase methods, may be selectively used for attachment to or filming toner particle surface, including particles of styrene resin, (meth)acrylic resin, styrene-(meth)acrylic resin, olefin resin, fluorine-containing resin, nitrogen-containing (meth) acrylic resin, silicon resin, benzoguanamine resin, melamine resin and derivatives thereof.

Available for use as the offset preventive agent are polyolefinic waxes, such as polyethylene, polypropylene, polyethylene of oxydised type and polypropylene of oxydised type, and natural waxes including carnauba wax. Magnetic particles available for use include those of iron, magnetite, γ-hematite, and various kinds of ferrite.

Available for use as the cleaning assistant are various kinds of fine resin particles, as granulated by wet polymerization methods, such as emulsion polymerization, soap-free emulsion polymerization, and non-aqueous dispersion polymerization, or vapor phase methods, including particles of styrene resin, (meth)acrylic resin, styrene-(meth)acrylic resin, olefin resin, fluorine-containing resin, nitrogen-containing (meth)acrylic resin, silicon resin, benzoguanamine resin, melamine resin, and derivatives thereof. Such fine resin particles may be externally added together with the fluidizing agent.

The invention will now be described in further detail with reference to particular examples given hereinbelow.

Production of Toner A

| | |
|---|---|
| styrene | 100 wt pts |
| n-butyl methacrylate | 35 wt pts |
| methacrylic acid | 5 wt pts |
| 2,2-azobis-(2,4-dimethylvaleronitrile) | 0.5 wt pt |
| low molecular-weight polypropylene "VISCOL 605P" (by Sanyo Kasei Kogyo K.K.) | 3 wt pts |
| carbon black "MA#8" (by Mitsubishi Chemical Industry Co., Ltd.) | 8 wt pts |

Above mentioned materials were mixed together by a sand stirrer to prepare a polymerizable composition.

The polymerizable composition was caused to undergo polymerization reaction in an aqueous solution of gum arabic of 3 wt % concentration at a temperature of 60° C. for 6 hours while being stirred by means of an agitating unit "TK Auto Homomixer" (made by Tokushu Kika Kogyosha) run at a rotational speed of 4000 rpm. As a result, spherical particles having a mean particle size of 6 μm were obtained. Thereafter, the process of filtration/washing was repetitively carried out, and the resulting mass of particles in a cake-like form was dried by a hot air dryer at 80° C. for 5 hours, so that particles were caused to form aggregates in such a way that extra-fine particles of 1 μm or less in particle size were caused to adhere to and become melted on the surface of particles having a particle size of 3 μm or more, being thus grown to a particle size of the order of 50 μm to 1 mm. As a result, toner aggregates having an aerated apparent density of 0.355 $g/cm^3$ were obtained. To 100 parts by weight of toner aggregates thus obtained was added 1 part by weight of a complex salt of metal salicylate "E-84" (made by Orient Kagaku Kogyo Inc.), and the both were mixed together. The mixture was subjected to disintegration/surface modification treatment by using "Criptron System KTM-3" (made by Kawasaki Heavy Industries Inc.) which was run at a rotational speed of 9,000 rpm (with a gap of 2 mm between the rotor and stator) To 100 parts by weight of disintegrated particles thus obtained was added 0.2 part by weight of hydrophobic silica "H-2000" (made by Wacker; BET specific surface area, 140 $m^2/g$; degree of hydrophobicity, 60), and the mixture was processed for one minute by a Henschel mixer (made by Mitsui-Miike Kakoki Inc.) which was run at 1000 rpm. As a result, toner A was obtained which had a mean particle size of 7 μm. Measurements by a powder tester showed that toner A had an aerated apparent density of 0.390 $g/cm^3$.

Production of Toner B

| | |
|---|---|
| styrene-n-butyl methacrylate copolymer resin (softening point: 132° C.; glass transition point: 60° C.) | 100 wt pts |
| carbon black "MA#8" | 8 wt pts |
| low molecular-weight polypropylene "VISCOL 550P" | 5 wt pts |

The foregoing materials were thoroughly mixed in a ball mill and then the mixture was kneaded on a three-roll mill heated to 140° C. After having been allowed to cool, the kneaded mixture was roughly ground by a feather mill and the resulting particles were pulverized by a jet mill. Then, air screening was made and, as a result, fine powder having a mean particle size of 7 μm was obtained. To 100 parts by weight of fine powder thus obtained was added 0.5 part by weight of complex salt of metal salicylate "E-84", and the mixture was thoroughly mixed and stirred. Thereafter, the mixture was subjected to fixing treatment by a hybridization system, model NHS-3 (made by Nara Kikai Seisakusho Inc.), which was run at a peripheral speed of 90 m/sec (with a gap of 1 mm between the rotor and the stator; treating time: 5 minutes). Then, to 100 parts by weight of colored particles thus obtained was added 0.2 part by weight of hydrophobic silica "H-2000", and the mixture was processed by a Henschel mixer (made by Mitsui-Miike Kakoki Inc.) at 1000 rpm for one minute. As a result, toner B was obtained which had a mean particle size of 7 μm. Toner B had an aerated apparent density of 0.385 g/cm$^3$ as measured by a powder tester.

Production of Toner C

| | |
|---|---|
| polyester resin "NE-382" (by Kao Inc.) | 100 wt pts |
| carbon black "MA#8" | 8 wt pts |
| low molecular-weight polypropylene "VISCOL 550P" | 5 wt pts |

The foregoing materials were thoroughly mixed in a ball mill and then the mixture was kneaded on a three-roll mill heated to 140° C. After having been allowed to cool, the kneaded mixture was roughly ground by a feather mill and the resulting particles were pulverized by a jet mill. Then, air screening was made and, as a result, fine powder having a mean particle size of 5.5 μm was obtained. To 100 parts by weight of fine powder thus obtained was added 0.5 part by weight of quaternary ammonium salt "P-51" (made by Orient Kagaku Kogyo Inc.), and the mixture was thoroughly mixed and stirred. Thereafter, the mixture was subjected to fixing and spherical particle forming treatment by a hybridization system, model NHS-3, which was run at a peripheral speed of 80 m/sec (with a gap of 8 mm; treating time: 5 minutes). Then, to 100 parts by weight of colored particles thus obtained was added 0.2 part by weight of hydrophobic silica "H-2000", and the mixture was processed by a Henschel mixer at 1000 rpm for one minute. As a result, toner C was obtained which had a mean particle size of 5.5 μm. Toner C had an aerated apparent density of 0.350 g/cm$^3$ as measured by a powder tester.

Production of Toner D

| | |
|---|---|
| styrene-n-butyl methacrylate copolymer resin (softening point: 132° C.; glass transition point: 60° C.) | 100 wt pts |
| carbon black "MA#8" | 8 wt pts |

-continued

| | |
|---|---|
| low molecular-weight polypropylene "VISCOL 550P" | 5 wt pts |
| chrome complex salt type azo dye "S-34" (made by Orient Kagaku Kogyo Inc.) | 5 wt pts |

The foregoing materials were thoroughly mixed in a ball mill and then the mixture was kneaded on a three-roll mill heated to 140° C. After having been allowed to cool, the kneaded mixture was ground by a feather mill and the resulting particles were pulverized by a jet mill. Then, air screening was made and, as a result, fine powder having a mean particle size of 5.5 μm was obtained. The fine powder thus obtained was subjected to spherical particle forming treatment by a hybridization system at a peripheral speed of 100 m/sec (with 1 mm gap; treating time: 5 minutes). Then, to 100 parts by weight of colored particles thus obtained was added 0.2 part by weight of hydrophobic silica "H-2000", and the mixture was processed by a Henschel mixer (made by Mitsui-Miike Kakoki Inc.) at 1000 rpm for one minute. As a result, toner D was obtained which had a mean particle size of 5.5 μm. Toner D had an aerated apparent density of 0.395 g/cm$^3$ as measured by a powder tester.

Production of Toner E

Suspension polymerized particles having a mean particle size of 5.8 μm were obtained in the same way as in production of toner A, except that the rotational speed of the auto homomixer was set at 5000 rpm. Thereafter, the process of filtration/washing was repetitively carried out, and the resulting mass of particles in a cake-like form was dried by a hot air dryer at 80° C. for 5 hours, so that particles were caused to form aggregates in such a way that extra-fine particles of 1 μm or less in particle size were caused to adhere to and become melted on the surface of particles having a particle size of 3 μm or more, being thus grown to a particle size of the order of 50 μm to 2 mm. As a result, toner aggregates having an aerated apparent density of 0.360 g/cm$^3$ were obtained To. 100 parts by weight of toner aggregates thus obtained was added 1 part by weight of quaternary ammonium salt "P-51", and the both were mixed together. The mixture was subjected to disintegration/surface modification by "Criptron System KTM-3" which was run at a rotational speed of 9,000 rpm (with a gap of 2 mm). To 100 parts by weight of disintegrated particles thus obtained was added 0.2 part by weight of hydrophobic silica "H-2000", and the mixture was processed for one minute by a Henschel mixer which was run at 1000 rpm. As a result, toner E was obtained which had a mean particle size of 5.5 μm. Measurements by a powder tester showed that toner E had an aerated apparent density of 0.370 g/cm$^3$.

Production of Toner F

Suspension polymerized particles having a mean particle size of 8 μm were obtained in the same way as in production of toner A, except that the rotational speed of the auto homomixer was set at 3000 rpm. Thereafter, the process of filtration/washing was repetitively carried out, and the resulting mass of particles in a cake-like form was dried by a hot air dryer at 80° C. for 5 hours, so that particles were caused to form aggregates in such a way that extra-fine particles of 1 μm or less in particle size were caused to adhere to and become melted on the surface of particles having a particle size of 3 μm or more, being thus grown to a particle size of the order of 50 μm to 2 mm. As a result, toner aggregates having an aerated apparent density of 0.355 g/cm$^3$ were obtained. To 100 parts by weight of toner aggregates thus obtained was added 1 part by weight of chrome complex salt type azo dye "S-34", and the both were mixed together. The mixture was subjected to disintegration/surface modification by "Criptron System KTM-3" which was run at a rotational speed of 9,500 rpm (with a gap of 2 mm). To 100 parts by weight of disintegrated particles thus obtained was added 0.2 part by weight of hydrophobic silica "H-2000", and the mixture was processed for one minute by a Henschel mixer which was run at 1000 rpm. As a result, toner F was obtained which had a mean particle size of 7.5 μm. Measurements by a powder tester showed that toner F had an aerated apparent density of 0.375 g/cm$^3$.

Production of Toner G

In 400 g of a mixed solvent of methylene chloride/toluene (8/2) was dissolved 100 g of polyester resin "NE-382" (made by Kao Inc). The solution, together with 5 g of phthalocyanine pigment and 5 g of zinc metal complex "E-84" (made by Orient Kagaku Kogyo Inc.), were added in this solution, and mixture was mixed in a ball mill for 3 hours for dispersion of the contents. Thus, a uniform mixture dispersion was obtained. Then, in an aqueous solution comprising 60 g of a 4% solution of methyl cellulose "Metocell K35LV" (made by Dow Chemical Company Inc.), 5 g of a 1% solution of sodium dioctyl sulfosuccinate "Nikkol OTP 75" (made by Nikko Chemical Inc.), and 0.5 g of sodium hexamethaphosphate (made by Wako Pure Chemical Industries Inc.) which, as dispersion stabilizers, were dissolved in 1000 g of deionized water, was added the uniform dispersion prepared as above described, and mixture suspended in water by using a TK Auto Homomixer (made by Tokushu Kika Kogyo Inc.), with the rotational speed of the mixer regulated to provide a mean particle size range of from 3 to 10 μm.

Thereafter, the process of filtration/washing was repetitively carried out, and the resulting mass of particles in a cake-like form was dried by a hot air dryer at 60° C. for 5 hours, so that particles were caused to form aggregates in such a way that extra-fine particles of 1 μm or less in particle size were caused to adhere to and become melted on the surface of particles having a particle size of 3 μm or more, being thus grown to a particle size of the order of 100 μm to 2 mm. As a result, toner aggregates having an aerated apparent density of 0.352 g/cm$^3$ were obtained. To 100 parts by weight of toner aggregates thus obtained was added 2 parts by weight of metal salicylate complex salt "E-84", and the both were mixed together. The mixture was subjected to disintegration/surface modification by "Criptron System KTM-3" which was run at a rotational speed of 8,000 rpm (with a gap of 2 mm). To 100 parts by weight of disintegrated particles thus obtained was added 0.2 part by weight of hydrophobic silica "H-2000", and the mixture was processed for one minute by a Henschel mixer which was run at 1000 rpm. As a result, toner G was obtained which had a mean particle size of 7.5 μm. Measurements by a powder tester showed that toner G had an aerated apparent density of 0.425 g/cm$^3$.

Production of Toner H

| | |
|---|---|
| styrene-methyl methacrylate resin (softening point: 138° C.; glass transition point: 65° C.) | 100 wt pts |
| low molecular-weight polyethylene "Hiwax 220P" (made by Mitsui Petrochemical Industries Inc.) | 3 wt pts |
| carbon black "MA#8" | 8 wt pts |
| Nigrosine-based dye "Bontron NB-EX" (made by Orient Kagaku Kogyo Inc.) | 3 wt pts |

The foregoing materials were thoroughly mixed in a ball mill and then the mixture was kneaded on a three-roll mill heated to 140° C. After having been allowed to cool, the kneaded mixture was roughly ground by a feather mill and the resulting particles were pulverized by a jet mill. Then, air screening was made and, as a result, a black color fine powder having a mean particle size of 7.8 μm was obtained. The fine powder thus obtained was subjected to fixing treatment by a hybridization system at a peripheral speed of 90 m/sec (with 2 mm gap; treating time: 7 minutes). Then, to 100 parts by weight of colored particles thus obtained was added 0.2 part by weight of hydrophobic silica "H-2000", and the mixture was processed by a Henschel mixer at 1000 rpm for one minute. As a result, toner H was obtained which had a mean particle size of 7.9 μm. Toner H had an aerated apparent density of 0.400 g/cm$^3$ as measured by a powder tester.

Production of Toner I

| | |
|---|---|
| styrene | 60 wt pts |
| n-butyl methacrylate | 35 wt pts |
| methacrylic acid | 5 wt pts |
| 2,2-azobis-(2,4-dimethylvaleronitrile) | 0.5 wt pt |
| low molecular-weight polypropylene "VISCOL 605P" | 3 wt pts |
| carbon black "MA#8" | 8 wt pts |
| metal salicylate complex "E-84" (made by Orient Kagaku Kogyo Inc.) | 3 wt pts |

Above mentioned materials were mixed together by a sand stirrer to prepare a polymerizable composition.

The polymerizable composition was caused to undergo polymerization reaction in an aqueous solution of gum arabic of 3 wt % concentration at a temperature of 60° C. for 6 hours while being stirred by means of an agitating unit "TK Auto Homomixer" (made by Tokushu Kika Kogyosha) run at a rotational speed of 4000 rpm. As a result, spherical particles having a mean particle size of 6 μm were obtained. To 100 parts by weight of particles thus obtained was added 0.2 part by weight of hydrophobic silica "H-2000", and the mixture was processed by a Henschel mixer at 1000 rpm for one minute. Toner I was thus obtained.

Production of Toner J

Toner J having a mean particle size of 8 μm was produced in the same way as in the method for production of toner I, except that 3 parts by weight of quaternary ammonium salt "P-51" (made by Orient Kagaku Kogyo Inc.) were added instead of metal salicylate complex salt. In this case, the rotational speed of TK auto homomixer was regulated to 3500 rpm.

Production of Toner K

| | |
|---|---|
| polyester resin "NE-382" (Kao Inc.) | 100 wt. pts. |
| carbon black "MA#8" | 10 wt. pts. |
| low molecular-weight polypropylene "VISCOL 550P" | 3 wt. pts. |
| chrome complex salt type azo dye "S-34" (made by Orient Kagaku Kogyo Inc.) | 5 wt. pts. |

Above mentioned materials were thoroughly mixed together, and then the mixture was melt-kneaded by a vent twin-roll kneader at 140° C. Thereafter, the melt-kneaded mixture was roughly ground by a feather mill and then pulverized by a jet mill. Air screening was made with respect to particles thus obtained. As a result, a black color fine powder having a mean particle size of 6.5 μm was obtained. Then, to 100 parts by weight of black particles was added 0.3 part by weight of hydrophobic silica "H-2000". The mixture was processed by a Henschel mixer at 1000 rpm for one minute. Toner K was thus obtained.

Production of Toner L

Toner L having a mean particle size of 8 μm was produced in the same way as in the method for production of toner K except that 5 parts by weight of a Nigrosinebased dye "Bontoron NB-EX" (made by Orient Kagaku Kogyo Inc.) were added instead of chrome complex salt type azo dye.

Production of Toner M

Toner M having a mean particle size of 6.5 μm was produced in the same way as in the method for production of toner K, except that the amount of hydrophobic silica was increased to 0.8 part by weight.

Production of Toner N

Toner N having a mean particle size of 6.5 μm was produced in the same way as in the method for production of toner M, except that the amount of hydrophobic silica was further increased to 1.5 parts by weight.

Production of Toner O

Toner O having a mean particle size of 7.0 μm was produced in the same way as in the method for production of toner A, except that no amount of hydrophobic silica was added.

Production of Toner P

Toner P having a mean particle size of 7.0 μm was produced in the same way as in the method for production of toner A, except that the amount of hydrophobic silica was increased to 1.0 part by weight.

Production of Carrier a

A coating solution was prepared by dissolving 20 parts by weight of acryl-modified silicone resin "KR9706" (made by Shin-Etsu Chemical Indudtry Inc.) in 400 ml of methyl ethyl ketone. The coating solution was sprayed by "Spiracoater", a spray coater (made by Okada Seiko Inc.), over a mass of Cu—Zn ferrite particles having a mean particle size of 50 μm, thereby to provide a resin coating. Then, the resin coated mass of particles was heated to 180° C. for 30 minites for curing the resin coat. Thus, an acryl-modified silicone resin coated carrier was prepared. Carrier bulks were taken out and the same was disintegrated by a grinder. Resulting particles were screened by means of a sieve of 90 μm mesh. Further, magnetic separation was carried out for removal of components having low magnetic force. As a result, a resin coated ferrite carrier a having a mean particle size of 50 μm was obtained.

Production of Carrier b

| | |
|---|---|
| polyester resin "Toughton NE1110" (made by Kao Corporation) | 100 wt. pts. |
| magnetic powder "EPT-1000" (made by Toda Kogyo Inc.) | 200 wt. pts. |
| carbon black "MA#8" | 2 wt. pts. |

The foregoing materials were mixed in a Henschel mixer, and the mixture was kneaded by a twin-screw extruder. After cooling, the kneaded mixture was roughly ground. The roughly ground product was pulverized and screened by a jet mill and an air screening machine respectively. As a result, a magnetic powder-containing fine polymer particles having a mean particle size of 2 μm was obtained. Then, 10 parts by weight of the magnetic powder-containing fine polymer particles were added to 100 parts by weight of ferrite carrier "F-250HR" (with mean particle size of 50 μm; made by Powderteck Co.), and the mixture was processed for 40 min by "Angmill AM-20F" (made by Hosokawa Micron Inc.) which was run at a rotational speed of 1000 rpm. Thus, carrier b was obtained which had a mean particle size of 55 μm. Further, the carrier b was subjected to heat treatment by a "surfusing system" (made by Nihon Pneumatic Kogyo Inc.) at 400° C., with the result that a finished carrier b having a mean particle size of 55 μm was obtained.

Experimental Examples

Toners A through P and carriers a and b which were produced as above described were used in such various combinations as shown in Table 1 to prepare developer of Examples 1 through 8 and those of Comparative Examples 1 through 8. Evaluation was made of the developer in various respects.

TABLE 1

| | Toner | Carrier | Volume mean particle size D of toner (μm) | Aerated apparent density A (g/cm³) | Aspect ratio B | 100 A–D |
|---|---|---|---|---|---|---|
| Ex. 1 | A | a | 7.0 | 0.390 | 1.35 | 32.0 |
| Ex. 2 | B | b | 7.0 | 0.385 | 1.37 | 31.5 |
| Ex. 3 | C | b | 5.5 | 0.350 | 1.39 | 29.5 |
| Ex. 4 | D | b | 5.5 | 0.395 | 1.27 | 34.0 |
| Ex. 5 | E | b | 5.5 | 0.370 | 1.32 | 31.5 |
| Ex. 6 | F | a | 7.5 | 0.375 | 1.39 | 30.0 |
| Ex. 7 | G | a | 7.5 | 0.425 | 1.28 | 35.0 |
| Ex. 8 | H | b | 7.9 | 0.400 | 1.35 | 32.1 |
| Com. Ex. 1 | I | a | 6.0 | 0.430 | 1.20 | 37.0 |
| Com. Ex. 2 | J | b | 8.0 | 0.440 | 1.18 | 36.0 |
| Com. Ex. 3 | K | b | 6.5 | 0.320 | 1.48 | 25.5 |
| Com. Ex. 4 | L | b | 8.0 | 0.350 | 1.45 | 27.0 |
| Com. Ex. 5 | M | b | 6.5 | 0.385 | 1.48 | 32.0 |
| Com. Ex. 6 | N | b | 6.5 | 0.430 | 1.48 | 36.5 |
| Com. Ex. 7 | O | a | 7.0 | 0.330 | 1.35 | 26.0 |
| Com. Ex. 8 | P | a | 7.0 | 0.435 | 1.35 | 36.5 |

Shown in Table 2 are evaluation results with respect to various characteristics of respective toners as developer.

TABLE 2

| | Quantity of Charge (μC/g) | | | | Fog | | | | |
|---|---|---|---|---|---|---|---|---|---|
| | 3 min. | 10 min. | 60 min. | 600 min. | H/H | L/L | Cleanability | Replenishability | BS |
| Example 1 | −28.5 | −30.0 | −31.0 | −30.5 | ◎ | ◎ | ○ | ○ | ○ |
| Example 2 | −28.0 | −29.8 | −30.0 | −30.5 | ◎ | ◎ | ○ | ○ | ○ |
| Example 3 | +34.3 | +35.9 | +35.5 | +35.4 | ◎ | ◎ | ○ | Δ | ○ |
| Example 4 | −37.9 | −40.0 | −39.6 | −39.7 | ◎ | ○ | ○ | ○ | ○ |
| Example 5 | +32.8 | +33.9 | +33.8 | +34.0 | ◎ | ◎ | ○ | ○ | ○ |
| Example 6 | −26.7 | −27.5 | −28.0 | −27.5 | ○ | ◎ | ○ | ○ | ○ |

TABLE 2-continued

| | Quantity of Charge (μC/g) | | | | Fog | | | | |
|---|---|---|---|---|---|---|---|---|---|
| | 3 min. | 10 min. | 60 min. | 600 min. | H/H | L/L | Cleanability | Replenishability | BS |
| Example 7 | −33.5 | −35.0 | −35.1 | −34.7 | ◎ | ◎ | ○ | ○ | ○ |
| Example 8 | +23.5 | +23.9 | +24.0 | +23.8 | ○ | ◎ | ○ | ○ | ○ |
| Comparative Example 1 | −30.1 | −33.0 | −37.6 | −44.8 | ○ | x | x | ○ | Δ |
| Comparative Example 2 | +19.4 | +23.2 | +30.1 | +37.3 | x | Δ | Δ | ○ | Δ |
| Comparative Example 3 | −28.7 | −35.0 | −38.9 | −47.0 | Δ | Δ | ○ | x | ○ |
| Comparative Example 4 | +13.7 | +20.1 | +25.3 | +37.6 | x | Δ | ○ | x | ○ |
| Comparative Example 5 | −30.5 | −36.7 | −40.1 | −49.5 | x | x | x | Δ | Δ |
| Comparative Example 6 | −33.4 | −37.9 | −41.5 | −48.0 | x | x | x | ○ | x |
| Comparative Example 7 | −15.5 | −19.7 | −28.0 | −31.2 | x | Δ | ○ | x | ○ |
| Comparative Example 8 | −35.2 | −33.6 | −32.1 | −25.3 | x | ○ | Δ | Δ | x |

Methods followed for evaluation are shown below.

(1) Particle Size

Measurement of mean particle size with respect to toner and carrier was made by using a "Coltar Multisizer" (made by Nikkakisha K. K.).

(2) Aerated Apparent Density

Measurement was made by using a "Powder Tester" (made by Hosokawa Micron Inc.)

(3) Charge Bearing Property

For the purpose of finding the quantity of charge, each individual toner for electrostatic latent image development was added to a carrier so that they were in the ratio of toner/carrier=5/95 (Tc=5 weight %), and the mixture was placed in a 50 cc plastic bottle. Plastic bottles containing such mixtures were rotated at 120 rpm on a rotary rack. In this way, developer with different toners were prepared. In measuring the quantity of charge, developer of 1 g each, weighed by a precision balance, were placed on the surface of a electroconductive sleeve 1 of a charge measuring apparatus in such a way that they were uniformly arranged on the entire surface of the sleeve as shown in FIG. 1. At the same time, the rotational speed of a magnet roll 2 disposed inside the electroconductive sleeve was set at 100 rpm.

Then, a bias voltage from a bias power source 3 was applied 3 kV opposite to the charge potential for toners, and the electroconductive sleeve 1 was rotated for 30 seconds, and when the sleeve 1 was stopped, potential Vm at a cylindrical electrode 4 was read. At the same time, the weight of toner attached to the cylindrical electrode 4 from sleeve 1 was weighed by a precision balance. In this way, a mean charge quantity (μC/g) of each toner was determined.

(4) Cleanability

For evaluation of cleanability feature, visual evaluation was carried out on image formed as well as on the photosensitive member. Evaluation was made on the following criteria.

○: No occurrence of imperfect cleaning on either image formed or photosensitive member.

Δ: Some imperfect cleaning occurred on photosensitive member but not on image.

x: Cleaning defect present on image.

(○ or above is preferable, though Δ is acceptable.)

(5) Fog

In connection with fog evaluation with respect to respective toners, image development was made by using an electrophotographic copying machine, "EP9765" (made by Minolta Inc.), for Examples 1, 5 and 8, and Comparative Examples 2 and 4, and a copying machine, "Di-30" (made by Minolta Inc.), for Examples 2, 3, 4, 6 and 7, and Comparative Examples 1 and 3. When a white paper image was developed, presence or non-presence of fog toner on the photosensitive member was verified by means of tape peeling, and fogging on transferred image was visually verified too. Environmental high temperature/high humidity (H/H) conditions were 30° C. and 85% RH, and environmental low temperature/low humidity conditions (L/L) were 5° C. and 15% RH. Evaluation was made on the following criteria.

◎: No fogging on either photosensitive member or image.

○: Some fogging on photosensitive member, but no fog on image.

Δ: Fogs present on photosensitive member (more than in the case of ○, but no fog on image).

x: Fogs present on image.

(○ or above is preferable, though Δ is acceptable)

(6) Aspect Ratio

The aspect ratio (long/shorter ratio) was measured by using a "Juliette Image Analyzer" (made by Seishin Kigyo Inc.).

Aspect ratio is a real number of not less than 1, and as the number is closer to 1, the long/short ratio is smaller.

(7) Black Spot (BS)

When BS should occur on the photosensitive member due to liberation of after-treatment agent from toner or due to other cause, it may appear in the form of noise on image.

Therefore, after a 10k print withstand test was conducted by using the same machine that was used in fog evaluation, occurrence or non-occurrence of BS on the photosensitive member was visually verified.

○: No BS occurrence on photosensitive member.

Δ: BS occurred on photosensitive member, but not on image.

x: Image noise occurred.

(8) Replenish Capability

Using only toner replenished portion at the digital electrophotocopying machine Di-30, measurements were made ten times with respect to the quantity of toner which dropped (toner supplied for replenishment) when the replenish motor was run for 10 seconds each. Evaluation was made according to the magnitude of variations in replenished quantity.

○: variation of less than 5% relative to the average of 10 time measurements.

Δ: variation of 5 to 15% relative to the average of 10 time measurements.

x: variation of more than 15%.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be constructed as being included therein.

What is claimed is:

1. A toner for electrophotography including toner particles containing at least a binder resin and a colorant, and a fluidizing agent added externally to the toner particles for mixture therewith, wherein the aerated apparent density A ($g/cm^3$) of the toner, the volume mean particle size D (μm) of the toner particles, and the aspect ratio B of the toner particles satisfy the following relations:

$29 \leqq 100A-D \leqq 35$ $5 \leqq D \leqq 8$ $1.25 \leqq B \leqq 1.40$.

2. A toner as defined in claim 1, wherein the aspect ratio is the ratio of a maximum diameter in a toner particle image to diameter passing through the center of gravity in orthogonal relation to the maximum diameter of toner particle.

3. A toner as defined in claim 1, wherein the aerated apparent density A and the volume mean particle size D satisfy the relation $31 \leqq 100A-D \leqq 33$.

4. A toner as defined in claim 3, wherein the aspect ratio B satisfies $1.30 \leqq B \leqq 1.38$.

5. A toner as defined in claim 1, wherein the fluidizing agent is at least one of inorganic particulates selected from silica, alumina and titania,

6. A toner as defined in claim 5, wherein the fluidizing agent is surface-treated with a hydrophobicity imparting agent.

7. A toner as defined in claim 6, wherein the fluidizing agent has a BET specific surface area of 50–250 $m^2/g$.

8. A toner as defined in claim 7, wherein the fluidizing agent has a hydrophobicity of 50 or more.

9. A toner as defined in claim 1, wherein the toner particles contain a charge control agent.

10. A toner as defined in claim 9, wherein the charge control agent is fixed to the surface of the toner particles.

11. A toner as defined in claim 9, wherein the proportion of the charge control agent is 0.01–20 parts by weight relative to 100 parts by weight of toner particle.

12. A toner as defined in claim 1, wherein the toner particles contain offset preventive agent.

13. A developer comprising a toner including toner particles containing at least a binder resin and a colorant, and a fluidizing agent added externally to the toner particles for mixture therewith, and a magnetic carrier, wherein the aerated apparent density A ($g/cm^3$) of the toner, the volume mean particle size D (μm) of the toner particles, and the aspect ratio B of the toner particles satisfy the following relations:

$29 \leqq 100A-D \leqq 35$ $5 \leqq D \leqq 8$ $1.25 \leqq B \leqq 1.40$.

14. A developer as defined in claim 13, wherein the aerated apparent density A and the volume mean particle size D satisfy the relation $31 \leqq 100A-D < 33$.

15. A developer as defined in claim 13, wherein the aspect ratio B satisfies $1.30 \leqq B \leqq 1.38$.

16. A developer as defined in claim 13, wherein the magnetic carrier comprises a magnetic core particle and a coating resin covering the core particle.

17. A developer as defined in claim 16, wherein the coating resin is of silicone resin.

18. A developer as defined in claim 17, wherein the silicone resin is a thermosetting silicone resin.

19. A developer as defined in claim 13, wherein the magnetic carrier comprises a binder resin and magnetic powder dispersed therein.

20. A developer as defined in claim 13, wherein the fluidizing agent has a BET specific surface area of 50–250 $m^2/g$ and a hydrophobicity of 50 or more.

* * * * *

UNITED STATES PATENT AND TRADEMARK OFFICE

CERTIFICATE OF CORRECTION

PATENT NO. : 5,763,229
DATED : June 9, 1998
INVENTOR(S) : Makoto KOBAYASHI, et al.

It is certified that error appears in the above-identified patent and that said Letters Patent is hereby corrected as shown below:

Column 18, Line 24, Delete "$<$" and insert "$\leq$"

Signed and Sealed this

Tenth Day of November 1998

*Attest:*

*Attesting Officer*

BRUCE LEHMAN

*Commissioner of Patents and Trademarks*